United States Patent [19]

Wright

[11] 4,147,151

[45] Apr. 3, 1979

[54] ENGINE MALFUNCTION PROTECTION

[76] Inventor: George L. Wright, 28 Hillside Dr., Downingtown, Pa. 19335

[21] Appl. No.: 754,316

[22] Filed: Dec. 27, 1976

[51] Int. Cl.[2] ..... F02B 77/08; F01P 5/14

[52] U.S. Cl. ..... 123/198 DC; 123/41.14; 123/196 S; 361/195

[58] Field of Search .... 123/198 D, 198 OB, 198 DC; 123/41.15, 196 S; 361/114, 195

[56] References Cited

U.S. PATENT DOCUMENTS

| | | | |
|---|---|---|---|
| 3,116,729 | 1/1964 | Crowe | 123/198 DC X |
| 3,362,388 | 1/1968 | Lindberg et al. | 123/198 D |
| 3,601,103 | 8/1971 | Swiden | 123/198 D X |
| 3,602,207 | 8/1971 | Kilmer | 123/198 D X |
| 3,914,735 | 10/1975 | Guillaume | 123/198 D X |
| 4,019,489 | 4/1977 | Cartmill | 123/198 D |

*Primary Examiner*—Ira S. Lazarus

*Attorney, Agent, or Firm*—Weiser, Stapler & Spivak

[57] ABSTRACT

A three-terminal module contains a relay with normally closed switch contacts and a delay circuit for the coil which opens the switch. The module switch contacts are wired between the engine ignition switch and the ignition coil of the engine. Malfunction detectors energize the delay, which eventually energizes the switch-operating coil, thereby stopping the engine. Opening and reclosing of the ignition switch enables the engine to restart.

12 Claims, 2 Drawing Figures

FIG. 1
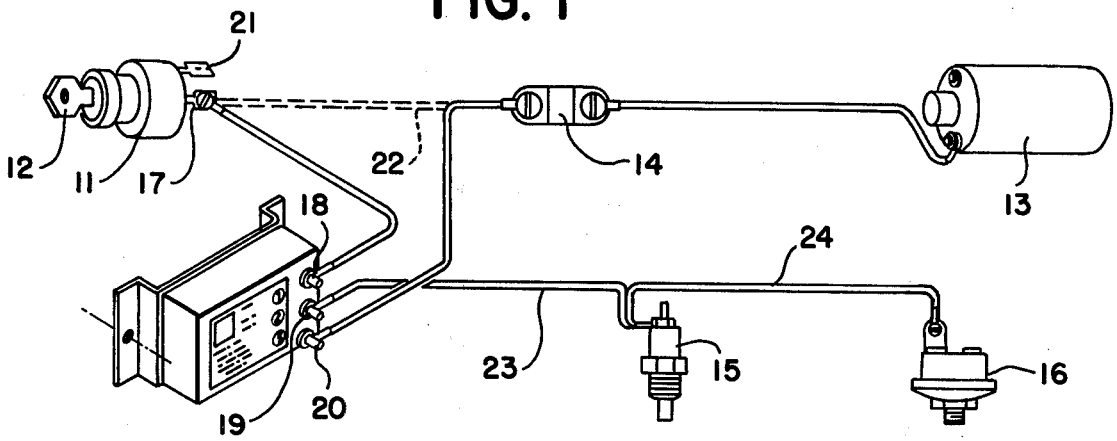
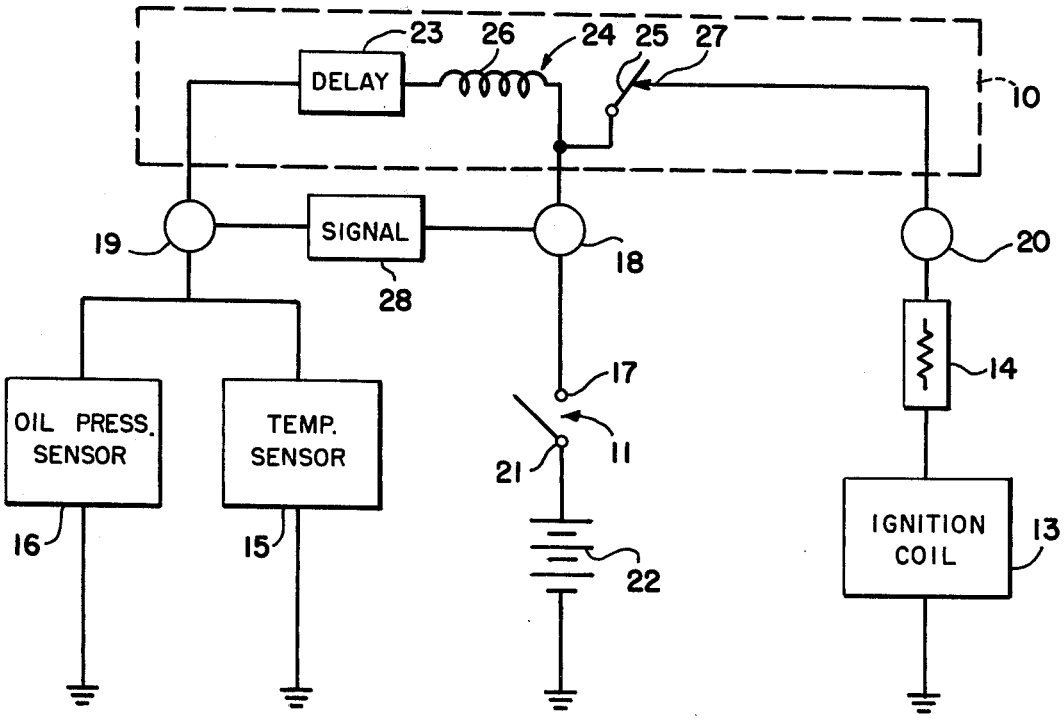
FIG. 2

ENGINE MALFUNCTION PROTECTION

This invention relates to apparatus for protecting engines from various types of malfunctions. More particularly, it relates to apparatus for protecting gasoline and diesel engines from such malfunctions as overheating and inadequate oil pressure.

The dangers of such malfunctions need hardly be explained in detail. Not only can they severely damage the engine affected but, in aggravated cases, they can even cause damage to other equipment. For example, the engine can actually seize up and, if it is the prime mover for a vehicle, this can cause loss of control over the vehicle and accidents as a result. Also, fires can start and this can cause widespread damage beyond the engine itself.

In recognition of such problems, there have been proposed numerous approaches to apparatus which would detect the malfunctions to be guarded against, and which would respond to their occurrence to shut down the engine. It has also been recognized in the prior art that it would be desirable to make this shut down take place not instantaneously upon detection of a malfunction, but rather after a predetermined interval of time, or delay. The purpose of providing this delay is twofold. When the engine is initially running, the delay gives an attendant or operator (e.g. the driver of the vehicle) an opportunity to react to a malfunction, either by correcting it or otherwise. When the engine is initially stopped, the time delay affords the opportunity to start the engine, without automatic shut down taking place, despite the fact that oil pressure, for example, may not be up to normal values during the starting operation.

What has been lacking, in these prior art efforts, is the degree of practicality which is important to their success. Complexity is one characteristic which has been conspicuous in the prior art. Not only has the apparatus itself been complex, but it has also required complex changes in the existing arrangement of the engine, and particularly its accessories, during installation. In turn, this has increased costs all around, for purchase, for installation, for maintenance. Another objectionable characteristic has been the need for performing some non-standard operation during usage of an engine so equipped. For example, during starting, an extra button might have had to be pushed and kept depressed, or some other extra manipulation performed.

Accordingly, it is an object of the invention to provide engine malfunction protection in a manner which is free from one or more of the shortcomings of the prior art.

It is another object to provide such protection in a manner not requiring additional operations during engine starting.

It is another object to provide such protection by apparatus which is simple in construction.

It is another object to provide such protection by apparatus which is simple to install.

These and other objects which will appear are achieved, in accordance with the present invention, by providing a single module containing all of the control circuitry for engine protection, as discussed above. This module is so constructed that the conventional ignition key can be used to start the engine, even with the module installed. Also a single wire is all that needs to be changed within the conventional engine wiring for installation of the module. The module provides means which responds to malfunction indications to deliver a shutdown signal after a predetermined interval. The module is capable of overriding the shutdown signal each time the engine is started (or restarted after shutdown). The module is also capable of delaying the malfunction-responsive shutdown and to energize a malfunction indicator.

For further details reference is made to the description which follows in the light of the accompanying drawings, wherein FIG. 1 shows the overall layout of an embodiment of the invention; and FIG. 2 shows certain circuitry details of the equipment of FIG. 1.

The same reference numerals are used in the different figures to designate similar elements.

Referring now to FIG. 1, this shows a system which includes a module 10, and engine ignition switch 11 into which there is shown inserted a removable ignition key 12. There is also shown an ignition coil 13, a resistor 14, a water temperature sensor 15 and an oil pressure sensor 16. The various elements in the system of FIG. 1 are interconnected as shown. Specifically, one of the terminals 17 of ignition switch 11 is connected to a terminal 18 on the outside of module 10. A second terminal 19 brought out from module 10 is connected first to water temperature sensor 15 and then to oil pressure sensor 16. It should be noted that these connections from module terminal 19 to sensors 15 and 16 are not electrical series connections but, in effect, are electrical parallel connections. The significance of this will become apparent later.

A third terminal 20 brought out from module 10 is connected to one end of resistor 14, the other end of which is connected to ignition coil 13.

It will be understood that the system of FIG. 1 shows only one side of the electrical connections within the actual engine control arrangement. The return side is provided, either by the conventional ground connections within the engine and its control sytem or, alternatively, by a separate return wire serving the purpose of a common ground connection. Thus, the terminal of ignition coil 13 which is not connected to resistor 14 may be grounded. Likewise, water temperature sensor 15 and oil pressure sensor 16 may have the opposite ends of their sensing elements connected to ground. Finally, from terminal 21 of ignition switch 10, which is the terminal not connected to module 10, a connection is made to one side of a conventional engine starting and operating battery (not shown) the other binding post of which may again be connected to the common ground prevailing within the entire engine assembly.

All of these connections are illustrated in FIG. 2, to which reference may now be had. FIG. 2 shows the electrical connections which prevail within the system of FIG. 1 and incuding battery 22, which supplies the electrical energy for the operation of the overall system.

The broken line rectangle 10 in FIG. 2 encloses the internal elements which form part of module 10 in FIG. 1. As will be seen these include two principal elements, namely a delay circuit 23 and a relay 24 for operating a switch whose movable element 25 is normally in the closed position as shown in FIG. 2. Actuating coil 26 of relay 24 is effective to move the element 25 out of contact with stationary switch element 27 when sufficient current flows through coil 26, thereby opening switch 24.

The individual elements shown in FIG. 2 may be entirely conventional. Thus ignition switch 11 may be of any conventional type. Likewise, relay 24 may be of any conventional type, and so may be ignition coil 13, attentuating resistor 14, temperature sensor 15 and oil sensor 16. The latter two sensors are preferably of the type in which there is an open circuit across them as long as the quantities being sensed (temperature and oil pressure respectively) are within their desired values. When they deviate from those values, the respective sensor then establishes a current flow path through it. In this way, in FIG. 2, the common connection point represented by terminal 19 is effectively connected to ground through the sensor which, at any given time, senses a value that is undesired, thereby indicating a malfunction.

Let us now assume that ignition switch 11 is closed, as would be the case if the engine were in operation. Let us also assume first that both oil pressure and engine temperature are at their desired values. Under those circumstances sensors 15 and 16 both present open circuits from terminal 19 to ground and, as a result, no current flows through actuating coil 26, and relay 24 is in the closed position shown in FIG. 2. Therefore, a complete current path exists to ignition coil 13 and nothing prevents the engine from continuing to operate.

In contrast, let it now be assumed that either temperature sensor 15 or oil pressure sensor 16 senses a malfunction. As previously stated this will cause the appropriate sensor to establish a current path through it from terminal 19 to ground. That, in turn, would cause current to flow through relay actuating coil 26, were it not for the presence in series with coil 26 of delay circuit 23. This delay circuit has the purpose of preventing the flow of such current through coil 26 as soon as one of the sensors 15 or 16 provides a path to ground. Rather, this delay circuit 23 remains substantially open circuited for a period of time after current through coil 26 would otherwise tend to flow. This delay circuit 23 may take a number of conventional forms. For example, this delay circuit may take the form of a thermistor connected in series between coil 26 and terminal 19. Such a thermistor would present high resistance when the current first begins to try to flow through it in response to sensing of a malfunction.

As this current continues to flow, it heats the thermistor which thereupon gradually decreases in resistance. This, in turn, permits increasing current to flow and that, in turn, further reduces its resistance which again permits a further increase in flow. By appropriate choice of the values of the various elements in the circuit of FIG. 2, it can be arranged that sufficient current will flow through coil 26 to cause actuation of relay 24 after an interval following a sensing of a malfunction which is within the design parameters.

For example, an interval of approximately 30 seconds duration is appropriate in many circumstances.

It will be understood that other types of delay circuits 23 can be used, some also relying on the heating effect of a circuit which is closed by malfunction sensing of either temperature sensor 15 or oil pressure sensor 16, and others of still other known types.

Preferably, the delay circuit which we use is of the type sold under the designation Timing Module Model 437 by Artisan Electronics Corporation, Parsippany, N.J.

As indicated in the specifications for this particular delay device, when the load with which it operates is inductive as would be the case in its application to the present invention, a resistor has to be connected across the coil of the relay, namely coil 26 in FIG. 2, to insure turn-on.

If desired, there may also be provided an additional signal 28 (FIG. 2) to indicate a condition of undesired temperature or oil pressure, as soon as this arises. This signal 28 is preferably connected so as not to be affected by delay circuit 23 but rather to provide its indication of malfunction as soon as such a malfunction occurs. For that reason the signal 28 is connected between terminal 18 and 19 of module 10. This signal may take the form of a warning light or audible warning device, such as a buzzer, as desired.

As will now be seen, assuming again that ignition switch 11 is closed and the engine is operating, as soon as a temperature or oil pressure malfunction is sensed, the signal 28 in FIG. 2 will so indicate. On the other hand, relay 24 will not operate immediately, but will leave switch elements 25, 27 in their closed position until delay circuit 23 permits actuating coil 26 to operate the relay 24, thereby disconnecting switch element 25 from switch element 27. Such disconnection interrupts the ignition circuit of the engine and thereby brings it to a stop.

Once this has happened, restarting can be accomplished by reopening ignition switch 11 and then closing it again.

Reopening this switch interrupts the current supply to coil 26, which thereupon releases the relay 24 and switch elements 25, 27 again become connected to each other. Also, incidentally, signal 28 is deenergized and ceases to provide its indication.

When the switch 11 is then reclosed, energization of the ignition coil 13 takes place and the engine starts to operate. For a brief interval following such startup, oil pressure sensor 16, particularly, will still indicate a malfunction, even if none exists. This is because the oil pressure will be undesirably low when the engine first starts to operate before the desired pressure builds up. The delay circuit 23 is effective to prevent the engine from shutting down again during this initial starting phase. The signal 28, not being subject to the operation of delay circuit 23, will provide its indication of malfunction immediately upon closing of switch 11. However, this must simply be ignored by the operator.

If, after the engine has started in this manner, a malfunction still exists, the disconnecting cycle of the ignition coil will recur and the engine will again come to a stop. On the other hand, if the malfunction has been relieved, or if the engine was shut off by opening ignition switch 11 for reasons other than malfunctioning, then the sensors 15 and 16 will not react and the ignition coil circuit will simply remain energized. The engine will therefore continue to operate normally until it is again shut off, either by ignition switch 11 or by the operation of relay 24 as previously explained.

The desirable features of the present invention will now be apparent.

The entire system of FIGS. 1 and 2 is seen to be simplicity itself. With the exception of module 10 and sensors 15 and 16, everything is completely conventional.

These devices are built of conventional elements which are in themselves conventional and the interconnections are also of the simplest possible type. Specifically, there will be in the conventional engine system already present the ignition switch 11, the ignition coil 13, and a connecting wire between the two which will include the resistor 14 if such a resistor is provided to protect the ignition circuit. All that needs to be done in order to insert module 10 into this conventional wiring is to cut the wire connection shown in broken lines at 22 in FIG. 1 and take one end of the broken connection, namely that attached to resistor 14 and connect it to terminal 20 of module 10, while taking the other end of this severed connection 22 namely that from ignition switch terminal 17 and connect it to terminal 18 of the module.

In addition, a single wire 23 is run to water temperature sensor 15 and from there a single wire to oil pressure sensor 16. Those are the only connections that need to be made within the engine compartment. As previously pointed out, if a signal device 28 is to be provided, this would additionally be connected between terminal 18 and 19 (see FIG. 2).

It will be understood that various modifications of this apparatus can be made without departing from the inventive concept. For example, additional sensors for various types of malfunction can be connected in parallel with temperature and oil sensors 15 and 16. Also, instead of applying the motor stopping cutoff to an ignition coil 13, the same could be applied to the solenoid of a fuel shutoff valve.

I claim:

1. Apparatus for protecting an engine from malfunctioning, comprising:

a unitary module having a single enclosure from which protrude only three functionally distinct electrical terminals, the enclosure containing electrically interacting components consisting only of a relay having normally closed switch contacts and a coil which responds to energization to open the contacts, a delay circuit connected to the coil for delaying the energization of the coil, the coil and delay circuit being connected between a first and second of the three terminals, and the contacts being connected between the first and the third of the three terminals.

2. The apparatus of claim 1 further comprising means connected to the third terminal and responsive to deenergization to stop the engine.

3. The apparatus of claim 2 further comprising an ignition switch for the engine and also connected to the first terminal of the module.

4. The apparatus of claim 3 further comprising means connected to the second terminal of the module for sensing an engine malfunction, the sensing means having high electrical resistance when not sensing a malfunction and having low resistance when sensing a malfunction.

5. The apparatus of claim 4 further comprising a source of electrical energy connected in series with the ignition switch.

6. The apparatus of claim 5, wherein the sensing means includes a plurality of sensors connected in parallel to the second terminal.

7. The apparatus of claim 5, further comprising audio-visual indicator means connected between the first and second terminals.

8. The apparatus of claim 5 wherein the ignition switch is actuatable by a removable ignition key.

9. The apparatus of claim 6 wherein one sensor is connected by a wire to the second terminal and another sensor is connected by a wire to the one sensor.

10. In a system for operating an engine with electrical ignition, which system includes means requiring electrical energization in order for the engine to operate, a source of electrical energy, an ignition switch connected between the energy source and the energization requiring means, and at least one engine malfunction sensing means having high electrical resistance when not sensing a malfunction and having low resistance when sensing a malfunction:

a single, unitary enclosure adapted to be mounted in the vicinity of the engine, said enclosure having only three electrical terminals protruding therefrom, and said enclosure containing only a relay having normally closed switch contacts and a coil which responds to energization to open the contacts, and a delay circuit connected to the coil for delaying the energization of the coil, the coil and delay circuit being connected between a first and second of the three terminals, and the malfunction sensing means being connected outside the enclosure to the second terminal, the ignition switch being connected outside the enclosure to the first terminal, and the energization requiring means being connected outside the enclosure to the third terminal, whereby sensing of a malfunction causes the relay switch contacts to open after the delay provided by the delay circuit, thereby interrupting the supply of electrical energy from the source to the energization requiring means and opening and reclosing of the ignition switch causes reclosing of the relay switch contacts, thereby reestablishing the said supply of electrical energy to the energization requiring means.

11. The system of claim 10 wherein the energization requiring means is the ignition means of the engine.

12. The system of claim 10 wherein the delay circuit provides a delay of approximately 30 seconds.

* * * * *.